US005462284A

United States Patent [19]

Felsenthal

[11] Patent Number: 5,462,284

[45] Date of Patent: Oct. 31, 1995

[54] AMUSEMENT OUTDOOR WATER SPRAY

[76] Inventor: Gil Felsenthal, 100 Merrick Rd., Suite 504 West, Rockville Centre, N.Y. 11570

[21] Appl. No.: 320,647

[22] Filed: Oct. 11, 1994

[51] Int. Cl.[6] ..... A63B 67/00

[52] U.S. Cl. ..... 273/413; 273/349

[58] Field of Search ..... 273/349, 413, 273/414, 331, 334, 335, 459; 446/153; 472/128

[56] References Cited

U.S. PATENT DOCUMENTS 3,843,127 10/1974 Lack ..... 273/349
4,165,073 8/1979 Kellerstrass ..... 273/413
4,573,679 3/1986 Janszen ..... 273/26 E
5,194,048 3/1993 Briggs ..... 472/128
5,338,044 8/1994 Mazursky et al. ..... 273/402

*Primary Examiner*—Jessica J. Harrison

[57] ABSTRACT

An outdoor water spray having two sprays, one at a top and a second at a medial location, the top spray showering the users and the second spray impinging upon a tethered ball causing erratic movements in the ball contributing to making a moving target thereof to correspondingly enhance the play value of the water spray.

2 Claims, 2 Drawing Sheets

AMUSEMENT OUTDOOR WATER SPRAY

The present invention relates generally to a child's water spray for outdoor lawn use, and more particularly to the combination thereof with a paddle and ball activity toy having the significant play value of both.

EXAMPLES OF THE PRIOR ART

Water sprays in playgrounds are, of course, well known.

It is also already well known to create from a source supplying water under pressure a play value activity, as described for example, in U.S. Pat. No. 3,843,127 issued to James E. Lack for "Water Guns And Water Emitting Target" on Oct. 22, 1974 and in U.S. Pat. No. 4,165,073 issued to Donald L. Kellerstree for "Water Gun Game With Revolvable Target Movable Along A Line" on Aug. 21, 1979.

In the aforesaid and all known water activity games or toys, the play value is provided solely by the activity game or toy, and typically is at the expense of using the water source as a spray or the like which, due to non-use for such purpose consequently does not make any play value contribution.

Broadly, it is an object to provide a combination water spray and water-activity game or toy overcoming the foregoing and other shortcomings of the prior art.

More particularly, it is an object to enable the utilization of the enjoyment benefits of the water spray and also to extend the functioning of the water spray to a water-activity game, to thereby obtain play value from both, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

DETAILED DESCRIPTION OF THE INVENTION

Figure 1:
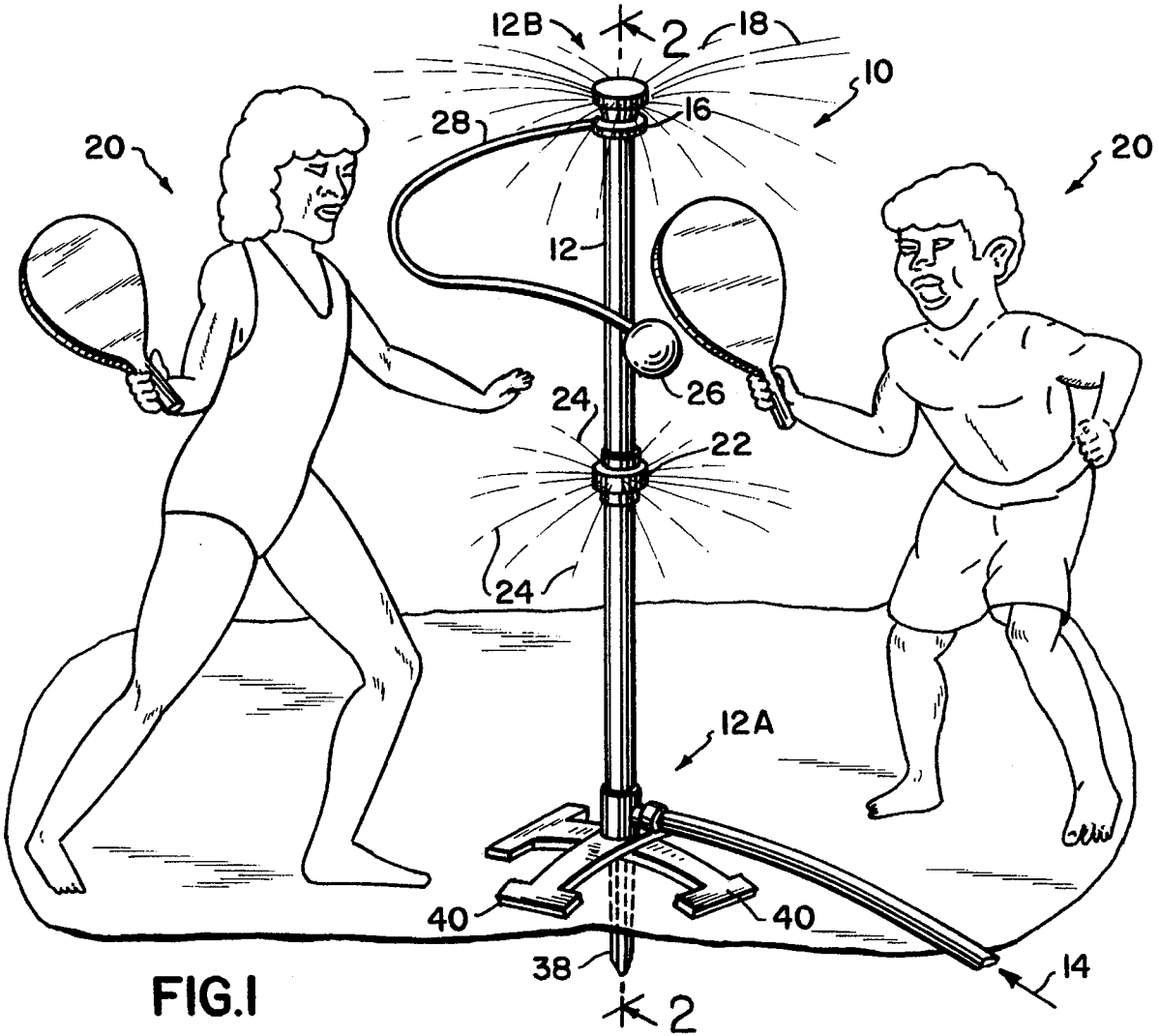
FIG. 1 is a perspective view illustrating use of the within inventive water spray and the attendant play value thereof.
Figure 2:
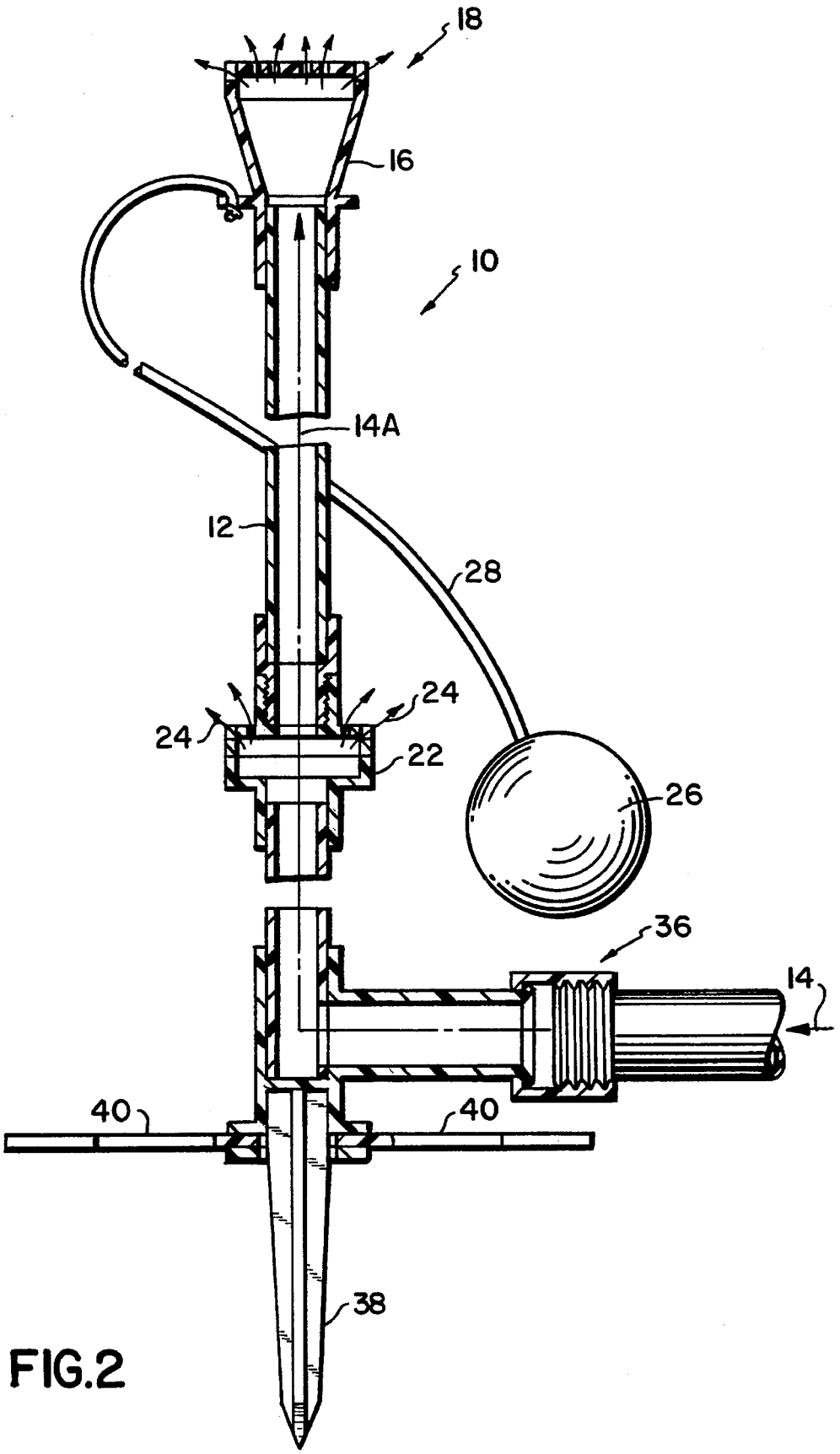
FIG. 2 is an isolated longitudinal sectional view as taken along line 2—2 of FIG. 1 of the water spray.

The present invention, as may best be understood from FIG. 1, is intended for use as an outdoor water spray, generally designated 10, using a hollow vertical tube 12 having at opposite bottom and top ends 12A and 12B respectively, a source of hose-delivered water 14 connected to said bottom end 12A and a first water spray nozzle 16 at said top end 12B. Consequently, the delivery of the water 14 under pressure causes same in a stream 14A to partake of ascending movement through the vertical tube 12 and to exit, as at the top 12B, as a spray 18 through the top nozzle 16. The one or more participant users 20 thus enjoy the play value of the top spray 18.

In accordance with the present invention, additional play value is embodied in the mode of use of the water spray 10 by a second water spray nozzle 22 at a medial location, as illustrated, in the ascending water stream movement through the tube 12. Consequently, some water is diverted and exits through the nozzle 22 as a second spray 24.

Provided as accessories to the water spray 10 is a ball 26, of rubber construction material, and a tether 28 connected at 30 to suspend the ball 26 from a ring 32 mounted at the tube top end 12B. The length of the tether 28 is selected to position the ball 26 in the water spray 24 so that the water impinging on the ball 26 urges it in erratic movements contributing to make it a moving target to be struck by paddles 34 used by the participants 20.

From the aforesaid description, the construction and operation of the within water spray 10 should be readily understood as having utility as an amusement outdoor water toy. For completeness sake, it is noted that the nozzles 16 and 22 and the hose connection at 36 are of any appropriate commercially available models, and that to maintain the tube 12 in its vertical orientation use is made of a depending plastic lawn-penetrating member 38 and criss-crossing legs 40.

Tube 12 optionally can be a continuous length or, as illustrated, for convenience in shipping, be supplied in two half lengths that are frictionally engaged to each other using to advantage for this purpose the second spray nozzle 22.

While the apparatus herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. Improvements for an amusement outdoor water spray of a type using a vertical tube having at opposite bottom and top ends a source of water connected to said bottom end for delivering water in ascending movement though said vertical tube and a spray connected to said top end for causing a spray of water exiting therefrom, said improvements comprising a second spray connected in a medial location on said vertical tube for diverting water in a second spray exiting therefrom at said medial location, a ball, and a tether attached in extending relation from said ball connected at said vertical tube top end such that said ball is impinged upon by said second spray, whereby said second spray urges said tethered ball in erratic movements contributing to making a moving target thereof to correspondingly enhance the play value of said amusement water spray.

2. An amusement outdoor water spray as claimed in claim 1 including in cooperating use therewith a paddle for a user thereof for attempted striking of said ball during said erratic movements thereof.

* * * * *